United States Patent [19]

Myklebust et al.

[11] Patent Number: 4,579,152

[45] Date of Patent: Apr. 1, 1986

[54] METHOD OF FILLING FLUIDIZABLE MATERIAL IN FLEXIBLE CONTAINERS

[75] Inventors: Eirik I. Myklebust; Bjarne Omdal, both of Porsgrunn, Norway

[73] Assignee: Norsk Hydro A.S., Oslo, Norway

[21] Appl. No.: 552,908

[22] Filed: Nov. 17, 1983

[30] Foreign Application Priority Data

Nov. 25, 1982 [NO] Norway ..... 823964

[51] Int. Cl.[4] ..... B65B 1/06

[52] U.S. Cl. ..... 141/10

[58] Field of Search ..... 141/10, 68, 76, 275, 141/295, 313, 315

[56] References Cited

U.S. PATENT DOCUMENTS

| | | | |
|---|---|---|---|
| 684,036 | 10/1901 | Bates | 141/10 |
| 870,215 | 11/1907 | Bates | 141/10 |
| 1,017,369 | 2/1912 | Bates | 141/76 |
| 2,622,780 | 12/1952 | Ackerman | 141/76 |
| 4,003,188 | 1/1977 | Lau | 141/68 X |
| 4,136,723 | 1/1979 | Skaadel et al. | 383/7 |
| 4,223,709 | 9/1980 | Myklebust | 383/7 |
| 4,269,247 | 5/1981 | Omdal | 383/8 |
| 4,420,021 | 12/1983 | Strand et al. | 141/10 |
| 4,467,845 | 8/1984 | Strand et al. | 141/10 |

*Primary Examiner*—Stephen Marcus
*Assistant Examiner*—Mark Thronson
*Attorney, Agent, or Firm*—Wenderoth, Lind & Ponack

[57] ABSTRACT

Fluidizable material is filled into a container by a simple and safe filling operation enabling the further transport of the filled container to be simplified. A plane during the filling operation and immediately thereafter is adjusted to an angle (y) of at least 2° to the horizontal and a support is adjusted to an angle (X) of at least 2° to the vertical, such that the container leans back against the support when it is filled with fluidizable material and does not slide off the bottom plane even when its lifting loops are released from a holding device. The bottom plane and the support can comprise a unit in which the bottom plane extends at about 90° to the rear wall of the support. The angles x and y can be equal or different and preferred values for these angles are 5°–15°.

3 Claims, 1 Drawing Figure

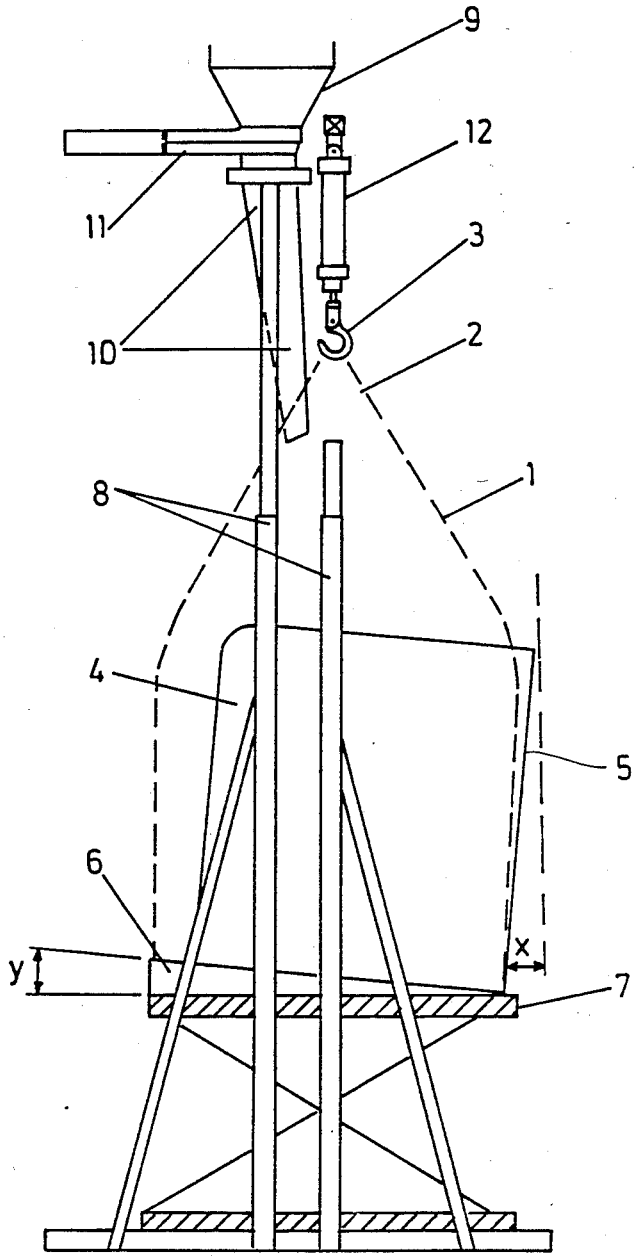
9
12
11
3
10
2
1
8
4
5
6
y
x
7

METHOD OF FILLING FLUIDIZABLE MATERIAL IN FLEXIBLE CONTAINERS

BACKGROUND OF THE INVENTION

The present invention relates to a method of filling fluidizable material into a flexible container, whereby container hangs from lifting loops during the filling operation and its bottom rests against a bottom plane which may be movable.

Fluidizable material, for instance cement, causes special problems during filling thereof into a container and during further handling of the filled container. The most important reason for this is that during the filling operation substantial air gets into the material such that it is fluidized and thereby behaves like a liquid. The consequence of this is that a container filled with fluidizable material will not be stable just after filling. Accordingly, the filled container cannot be disconnected right away from the filling apparatus and placed directly on a conveyor or left standing on a pallet because it quite easily will tilt or slide to the ground.

Several methods have been tried for solving these problems in order to arrive at efficient applications of flexible containers for fluidized material. One method used comprises filling the container while it is hanging on the forks of a truck and thereupon transport the container to storage immediately after the filling operation is completed. However, the container must be hanging sufficiently long on the truck to let a substantial part of the fluidizing air be removed before the container can be placed on a plane surface and stay there without support. Such a method requires application of several trucks and an intermediate storage facility for the filled containers, and the method will accordingly prevent fast filling and further handling of stable containers.

Further known is a filling method and means which enable faster filling and further transport of the filled container, as described in EP-application No. 81108746 (publication No. 64095). Even though such means renders it possible to obtain a faster and more economic further transport of the filled container, there still exist problems with respect to obtaining a stable container immediately after the filling operation.

It further is known to place a flexible container in a cylindric device while it is filled with fluidizable material. The filling process itself is then simple to carry out, but when the filled container is removed from the device several problems arise. Such a filling method requires large space, especially when the container is to be lifted out of the supporting device. Special equipment is also required for this operation.

SUMMARY OF THE INVENTION

The object of the present invention is to provide a method of filling fluidizable material into flexible containers by a simple and safe filling operation, while at the same time enabling further transport of the filled container to be carried out in a simple and safe way without having to use special transport equipment.

As mentioned above, it has been found that flexible containers filled with fluidizable material will be unstable during the filling operation and for some time thereafter. For several years numerous methods have been tried to solve this stability problem but without success, and therefore the present inventors decided to accept the fact that a container containing fluidizable material is unstable until the fluidizing air is removed. Fast removal of the fluidizing air from the container has in practice has been found to be impossible, and one would therefore try to find a method of filling and transporting such a container when it was unstable. One had earlier been able to store intermediately unstable containers by letting them stand against a support until the air had left them. It was therefore tried to find support means which were suitable during filling and which at the same time made it possible to remove the unstable container from the filling apparatus in a rational way.

It was then surprisingly found that a container can be filled with fluidizable material without sliding out of the filling apparatus if the container stands on an inclined surface and at the same time leans against a plane which deviates a few degrees from the vertical. During the further development of this idea one arrived at a simple and efficient filling method. The container lifting loops are fastened to a holding device which preferably can be lifted and lowered vertically. The container then is placed in a support means such that the walls of the container are at least partially pressed against the support mens when fluidizable material is filled into the container. The container bottom is placed on a bottom plane which deviates a few degrees from the horizontal. A simple way of obtaining the desired effect is to form the support means and the bottom plane as a unit in which the rear wall extends about 90° to the bottom plane. This unit can be arranged such that it may be lifted and lowered vertically. Several such units may be arranged on a conveyor or a circular rack. The filled container thus may be removed from the filling apparatus itself and left standing for deaeration while new containers are filled.

The shape of the support means can be varied, the important thing is that the filled container leans against it and does not fall or slide out of it. The angles between the respective vertical and the horizontal planes have surprisingly been found to be quite small, for instance only 2°, in order to obtain a good effect. 5°–15° has been found to be the most practical value, but it is possible to apply up to 45°.

BRIEF DESCRIPTION OF THE DRAWINGS

The invention will now be further explained with reference to the accompanying drawing, the single FIGURE of which is a schematic view of an apparatus which is suitable for carrying out the invention.

DETAILED DESCRIPTION OF THE INVENTION

The drawing shows an apparatus for filling a flexible container 1 lifting loops 2. In a frame 8 there is placed a support having means 4 which surrounds about half of the circumference of the flexible container. Rear wall 5 of the support means forms an angle x with the vertical plane, and a bottom wall or plane 6 which can be an integrated part of the support means 4, forms an angle y with the horizontal plane. The angle x can be equal to or different from the angle y. The support means 4 and the bottom plate 6 are arranged on a lifting table 7 which can be regulated vertically. To the frame 8 there is connected an intermediate container 9 with a discharge flap 11 and a filling pipe 10. The apparatus comprises a holding device 12 fastened to the frame 8 and also having a hook 3.

The invention is carried out by first filling fluidizable material into the container 9 with the flap 11 therefore in the closed position. The lifting loops 2 of the flexible container 1 are then fastened on to the hook 3 which is hoisted to a raised position at the same time as the filling pipe 10 is conveyed into the container 1. Means for removing dust and for supplying air may be connected to the filling pipe, but such means are not herein illustrated. The container 1 thus hangs in the support means 4. Before the fluidizable material is emptied into the container by opening the flap 11, the container is preferably filled with air. During the first part of the filling operation it has been found to be most advantageous to let the container 1 hang with substantially all its weight on the hook 3. That means that the container bottom does not rest against the plane 6 and that the lifting table 7 is in a lowered position. At the end of the initial portion of the filling operation of the container 1 the lifting table 7 and thereby the plane 6 are moved upward such that most of the container weight is supported by the plane 6. By carrying out the filling operation in this manner, it is possible to fill more fluidizable material into the container than is possible when the container bottom rests against the bottom plane 6 during the entire filling operation.

When the container is filled with the desired amount of fluidizable material, the hook 3 is lowered and the lifting loops 2 are released from the hook. The container thus leans against the inclined rear wall 5 and is supported by the means 4 which extends partially around the container 1, i.e. around approximately half of the circumference of the container, and which together with the slightly inclined plane 6 prevents the filled container from sliding out of the filling apparatus.

The container can now be removed by connecting the lifting loops to a conventional lifting device connected to a truck or some other transport means and can be transported to an intermediate storage location.

By means of the present invention it is possible in a simple manner to employ flexible containers for fluidizable material and at the same time to obtain rapid and safe handling of the filled containers.

We claim:

1. A method of filling fluidizable material into a flexible container of the type having at least one lifting loop, said method comprising:

suspending said container by said at least one lifting loop;

during an initial portion of an operation of filling said container, introducing fluidizable material into said container while supporting substantially the entire weight of said container being filled by said lifting loop;

providing a support having a bottom wall extending at an angle of 2°–15° to the horizontal and a rear wall extending at an angle of 2°–15° to the vertical;

after said initial portion of said filling operation, moving said bottom wall and said rear wall upwardly against said container; and thereafter, completing said filling operation while maintaining said support in contact with said container, thereby causing said container to lean against said rear wall, and thereby supporting substantially the entire weight of said container being filled by said support.

2. A method as claimed in claim 1, comprising providing said support with a configuration to extend around approximately half of the circumference of said container, thereby providing support for said container being filled laterally adjacent said rear wll.

3. A method as claimed in claim 1, further comprising, after completion of said filling operation, releasing suspension of said lifting loop, thereby entirely supporting the filled container by said support, and thus preventing said filled container from sliding from said bottom wall.

* * * * *